United States Patent [19]

Ueyama et al.

[11] 4,338,873

[45] Jul. 13, 1982

[54] THREAD CHAIN SEWING METHOD AND DEVICE FOR USE IN THE TWO-NEEDLE OVERLOCK SEWING MACHINE

[75] Inventors: Yoshinari Ueyama; Kikuo Mori, both of Osaka; Hideo Matsushita, Hyogo, all of Japan

[73] Assignee: Pegasus Sewing Machine Mfg. Co., Ltd., Japan

[21] Appl. No.: 162,522

[22] Filed: Jun. 24, 1980

[30] Foreign Application Priority Data

Mar. 14, 1980 [JP] Japan ..... 55-32909

[51] Int. Cl.[3] ..... D05B 1/10

[52] U.S. Cl. ..... 112/262.1; 112/165

[58] Field of Search ..... 112/262.1, 269.1, 163, 112/165, 166, 197–202

[56] References Cited

U.S. PATENT DOCUMENTS 3,100,469 8/1963 Washburn ..... 112/269.1 X 4,175,499 11/1979 Navlyt ..... 112/165

4,186,676 2/1980 Villa et al. ..... 112/165

*Primary Examiner*—Peter P. Nerbun

*Attorney, Agent, or Firm*—Steele, Gould & Fried

[57] ABSTRACT

A thread chain sewing method and device for use in the two-needle overlock sewing machine comprising an inner chaining-off finger arranged to be retractable from an advanced position in which it is positioned alongside an outer chaining-off finger. The inner chaining-off finger is retractable in a direction opposite the fabric material feeding direction. The inner chaining-off finger is held in its advanced position during sewing over the fabric as well as during a thread chain forming period after the trailing edge is stitched. Thread chains formed before the start of sewing are wrapped only over the outer chaining-off finger, while thread chains formed after the trailing edge of the material passes are bridged over the inner and outer chaining-off fingers.

12 Claims, 13 Drawing Figures

THREAD CHAIN SEWING METHOD AND DEVICE FOR USE IN THE TWO-NEEDLE OVERLOCK SEWING MACHINE

BACKGROUND OF THE INVENTION

The present invention relates to a thread chain sewing method and device for use in the two-needle overlock sewing machine.

When over-edging the edge of a fabric material with the overlock sewing machine, continuous thread chains connected to the fabric material are formed at the finish of sewing. In the case of one-needle overlock sewing machines in which three threads are used, a thread chain holding and cutting means is arranged on the operator's side of the needle drop point. When sewing is finished, continuous thread chains connected to the fabric material are shifted toward the operator to be held by the thread chain holding and cutting means, and are then cut off from the fabric material. Therefore, thread chains held by the thread chain holding and cutting means can be atuomatically folded and sewn into the seam of a subsequent section of fabric material, thus preventing the seam from being frayed at the beginning of the seam without requiring the back-tacking operation of a back-tacking machine.

However, the two-needle overlock sewing machine could not smoothly attain the automatic sewing of thread chains into the seam. Automatic folding and sewing of thread chains into the seam requires that the thread chains previously formed and entangled around the chaining-off fingers be folded and sewn into the seam as the next fabric segment is sewn. The two-needle over-lock sewing machine has two needles, and chaining-off fingers are arranged at one side of the needle drop point of each needle, that is, the inner and outer chaining-off fingers are arranged side by side, one on either side of the needle drop point of the outer needle. Therefore, in the case of the two-needle overlock sewing machine, thread chains formed before the sewing process reaches the fabric material are normally wrapped around the inner and outer chaining-off fingers. As the result, thread chains held by the thread chain holding and cutting means are sewn together with newly formed thread chains. Or when being folded and sewn into the seam, thread chains are sewn to the fabric material by the thread of the outer needle and the subsequent folding and sewing of thread chains into the seam is not carried out, leaving almost all of the thread chain projecting at the beginning of the seam.

In order to eliminate these drawbacks, the inventors of the present invention have developed a thread chain sewing method and device for use in the two-needle overlock sewing machine wherein the inner chaining-off finger, which was conventionally fixed alongside the outer chaining-off finger, is retractable in a direction opposite the fabric material feeding direction and held in its retracted position during the non-sewing time. Thread chains formed before the sewing process reaches the fabric material are wrapped only around the outer chaining-off finger without bridging both inner and outer chaining-off fingers, thus preventing previously formed thread chains from being sewn to the fabric material by thread of the outer needle at the time the sewing process reaches the fabric segment and allowing thread chains to be smoothly folded and sewn into the seam.

However, according to tests conducted using the device, it has become apparent that if the inner chaining-off finger is retracted at the moment when the sewing process is finished, that is, at the time when the trailing end of fabric material has passed through the needle drop points, thread chains formed after the sewing process are not wrapped around the inner chaining-off finger, thus making it impossible to form symmetrical and beautiful thread chains and to fold and sew thread chains into the seam beautifully at the time the sewing process is applied to a subsequent segment of fabric material.

SUMMARY OF THE INVENTION

An object of present invention is to provide a thread chain sewing method and device for use in the two-needle overlock sewing machine wherein thread chains are formed narrow in width and not entangled around the inner chaining-off finger before the sewing process reaches the fabric material, thus preventing thread chains held by the thread chain holding and cutting means from being sewn together with newly formed thread chains and also preventing thread chains from being sewn to the fabric material by the thread of the outer needle when being folded and sewn into the seam.

Another object of present invention is to provide a thread chain sewing method and device for use in the two-needle overlock sewing machine wherein thread chains formed right after the sewing process is finished are bridged over the inner and outer chaining-off fingers to form symmetrical and beautiful thread chains which can be smoothly and beautifully folded and sewn to the seam of a subsequent segment of fabric material.

The term "sewing machine operation" used herein represents the whole of the operating processes necessary to sew a sheet of fabric material. Namely, it represents a series of operating processes including the start of operation of the sewing machine, the sewing process applied to the fabric material, the forming of thread chains after the sewing process is finished, and the stop of operation of the sewing machine. The "sewing process" represents the period in which over-edging is practically done relative to the fabric material itself.

DETAILED DESCRIPTION OF THE PREFERRED EMBODIMENTS

Figure 1:
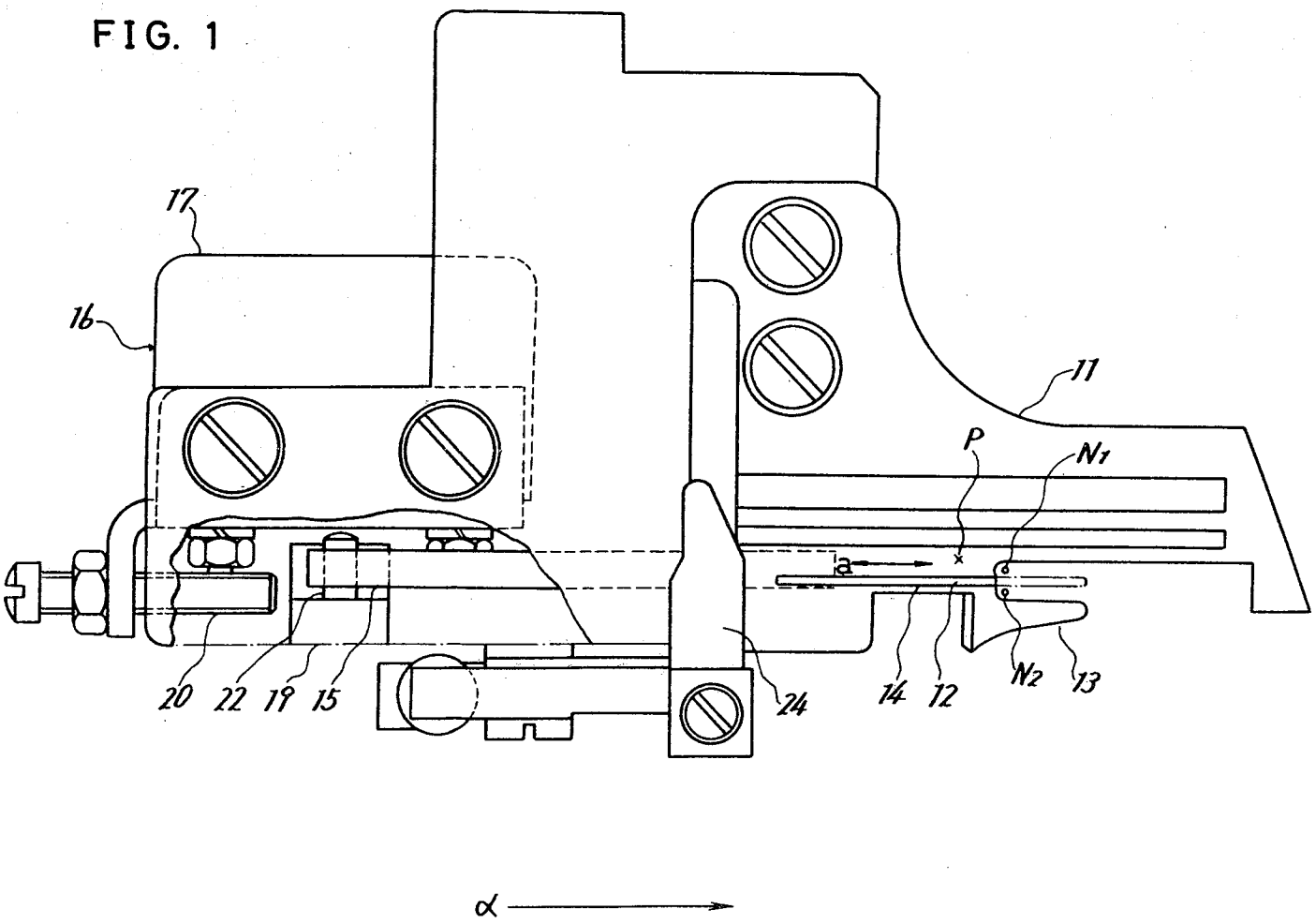
FIG. 1 is a plan view showing a needle plate and the portion adjacent thereto, employed in an embodiment of the present invention.
Figure 2:
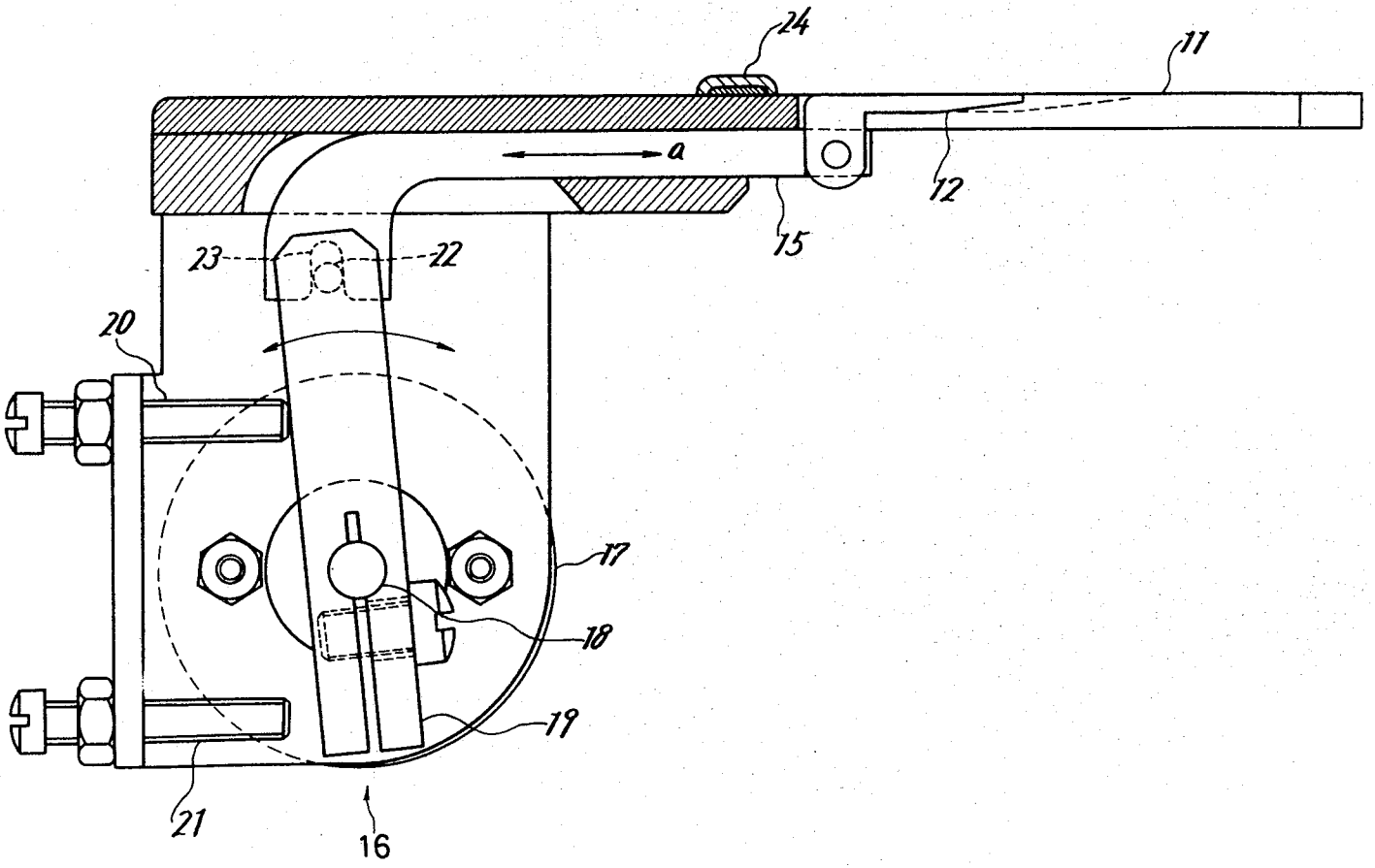
FIG. 2 is a side view showing the needle plate portion shown in FIG. 1.

In FIGS. 1 and 2, numeral 11 represents a needle plate of a two-needle overlock sewing machine. The inner one of the inner and outer chaining-off fingers 12 and 13, which are to be arranged respectively outside (or below in FIG. 1) needle drop points $N_1$ and $N_2$ of needle plate 11, is retractable from the position in which it is alongside the outer chaining-off finger as shown by a dash-and-dot line in FIG. 1, in a direction approaching the operator and opposite to the fabric material feeding direction $\alpha$, as shown by an arrow a. Namely, the inner chaining-off finger 12 is formed separately from the needle plate 11; the needle plate 11 is provided with a slot 14 through which the inner chaining-off finger 12 is reciprocated; a slide lever 15 is arranged at the backside of needle plate 11 so as to freely reciprocate along the slit 14; and, the inner chaining-off finger 12 is fixed to the foremost end of slide lever 15.

The inner chaining-off finger 12 is reciprocated by a driving means 16 through the slide lever 15. The driving means 16 comprises a rotary solenoid 17, a driving lever 19 the middle portion of which is fixed to a rotating shaft 18 of rotary solenoid 17, and stops 20 and 21 whose ends are contacted by driving lever 19 so as to limit the rotating angle of driving lever 19. The driving lever 19 is urged in the counter-clockwise direction in FIG. 2 by means of a return coil spring (not shown) wound around the rotating shaft 18. A pin 22 projecting from one upper side of driving lever 19 is fitted into a recess 23 provided in the lowermost end of the lower L-shaped portion of slide lever 15.

A thread chain holding and cutting means 24 is arranged at a certain distance, spaced from needle drop points $N_1$ and $N_2$ of needle plate 11 toward the operator. This means 24 is of a type commonly used in the one-needle overlock sewing machine or the like.

A fabric material detection means or sensor 76 and a pulse generator 77 are provided, said sensor 76 serving to detect whether or not the fabric material is set at needle drop points $N_1$ and $N_2$ of sewing machine body 41 and said pulse generator 77 serving to generate a pulse synchronized with the stitching operation of the needles.

Figures 3A, 3B:
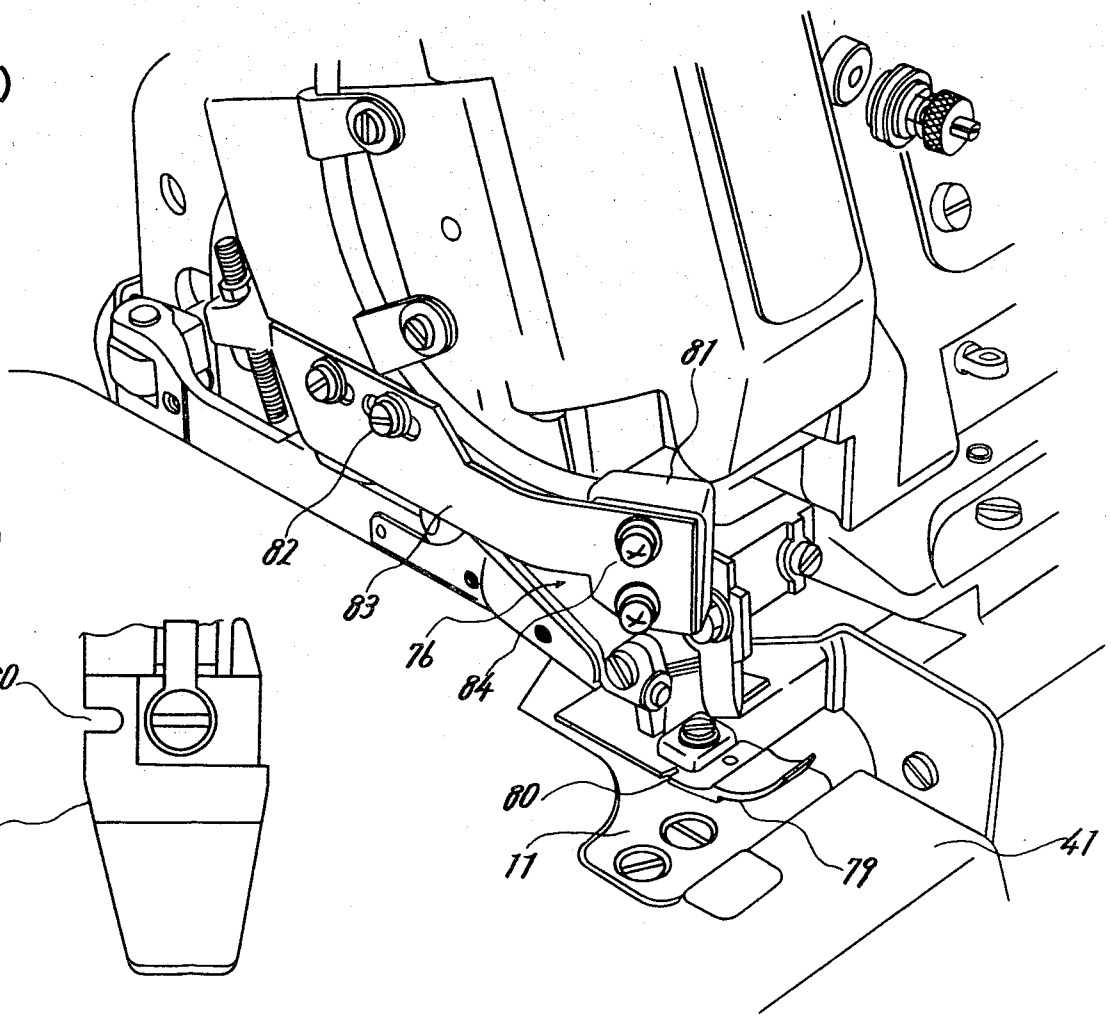
FIG. 3*a* is a perspective view showing a fabric material detection section in the embodiment of the present invention.
FIG. 3*b* is a plan view showing a pressing plate.
Figure 4:
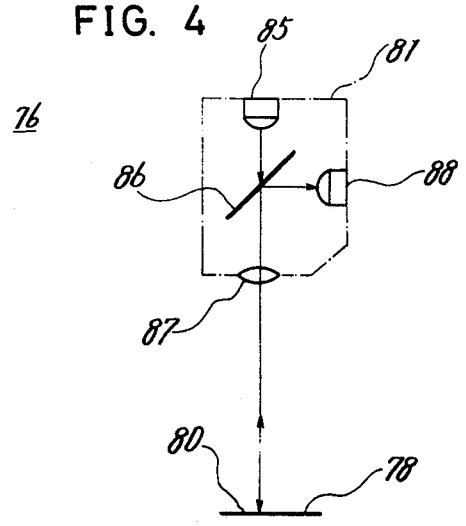
FIG. 4 is a schematic view showing a photo-sensor in the embodiment of the present invention.

As shown in FIG. 3, the fabric material sensor 76 includes a recess 80 formed at one edge and on the operator's side of the needle drop points of a pressing plate 79. The pressing plate is arranged over the needle plate 11, and a photo-sensor 81 is arranged right above the recess 80 and attached to the foremost end of an auxiliary plate 83 by means of a screw 84, said auxiliary plate 83 being attached to the sewing machine body 41. As shown in FIG. 4, the photo-sensor 81 includes a light-emitting diode 85 arranged right above the recess 80, a semitransparent mirror 86, slanted by 45 degrees relative to the light-emitting diode 85, a condensing lens 87, and a photo-transistor 88, shifted by 90 degrees from the light-emitting diode 85. The light emitted from the light-emitting diode 85 reaches the recess 80 passing through half-mirror 86 and condensing lens 87, is reflected to return through the condensing lens 87, and further reflected by the semitransparent mirror 86 to be received by the phototransistor 88.

The fabric material sensor 76 is intended to detect the presence of fabric material depending on the brightness of reflected light, since the light reflected by the mirror-like surface of needle plate 11 is low in brightness when the fabric material is present at the recess 80 but high when not present.

Figure 5:
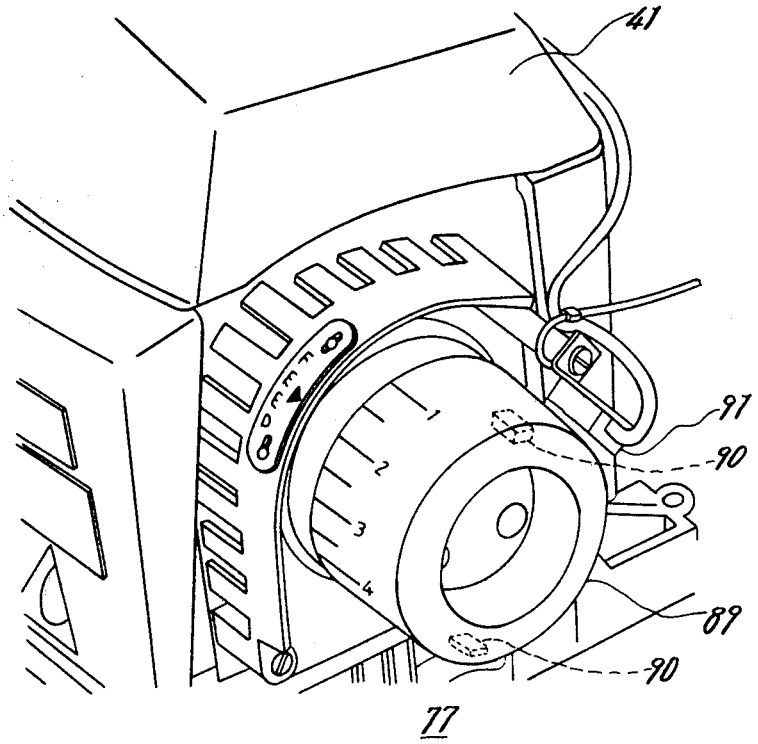
FIG. 5 is a perspective view showing a pulse generator in the embodiment of the present invention.

The pulse generator 77 is connected directly to a crankshaft (not shown) of the sewing machine body 41, as shown in FIG. 5, and comprises a pulley 89 which rotates synchronously with the stitching operation of the needles, two permanent magnets embedded opposite each other in the pulley 89, and a magnetic sensor 91 arranged adjacent to the pulley 89. The pulse generator 77 generates two pulses for every rotation of pulley 89, that is, for every stitching operation of the needle.

The reason why two pulses are generated for every stitching operation of the needles is to enhance the timing precision in driving the inner chaining-off finger forward and to make accurate the changeover timing between the forming of thread chains and assembly seaming at the edge of the fabric material. For example, when a pulse is generated for every stitching operation, an error equal to one stitch may be caused, while when two pulses are generated for every stitching operation, the error can be reduced to half a stitch. Therefore, as the number of pulses generated every stitching operation is increased, the timing precision can be enhanced.

Figure 6:
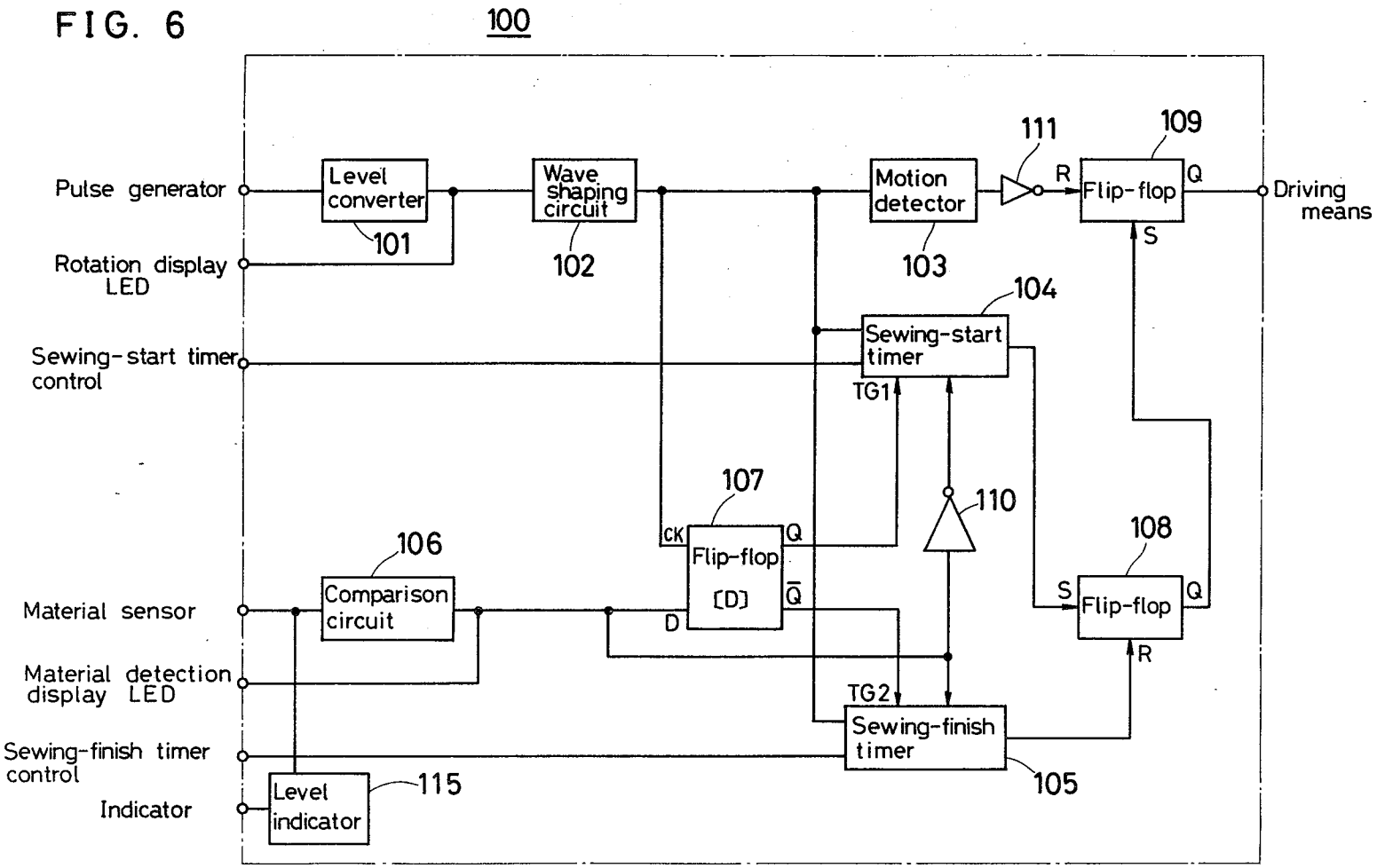
FIG. 6 is a block diagram showing a control circuit employed in the embodiment of the present invention.
Figure 7:
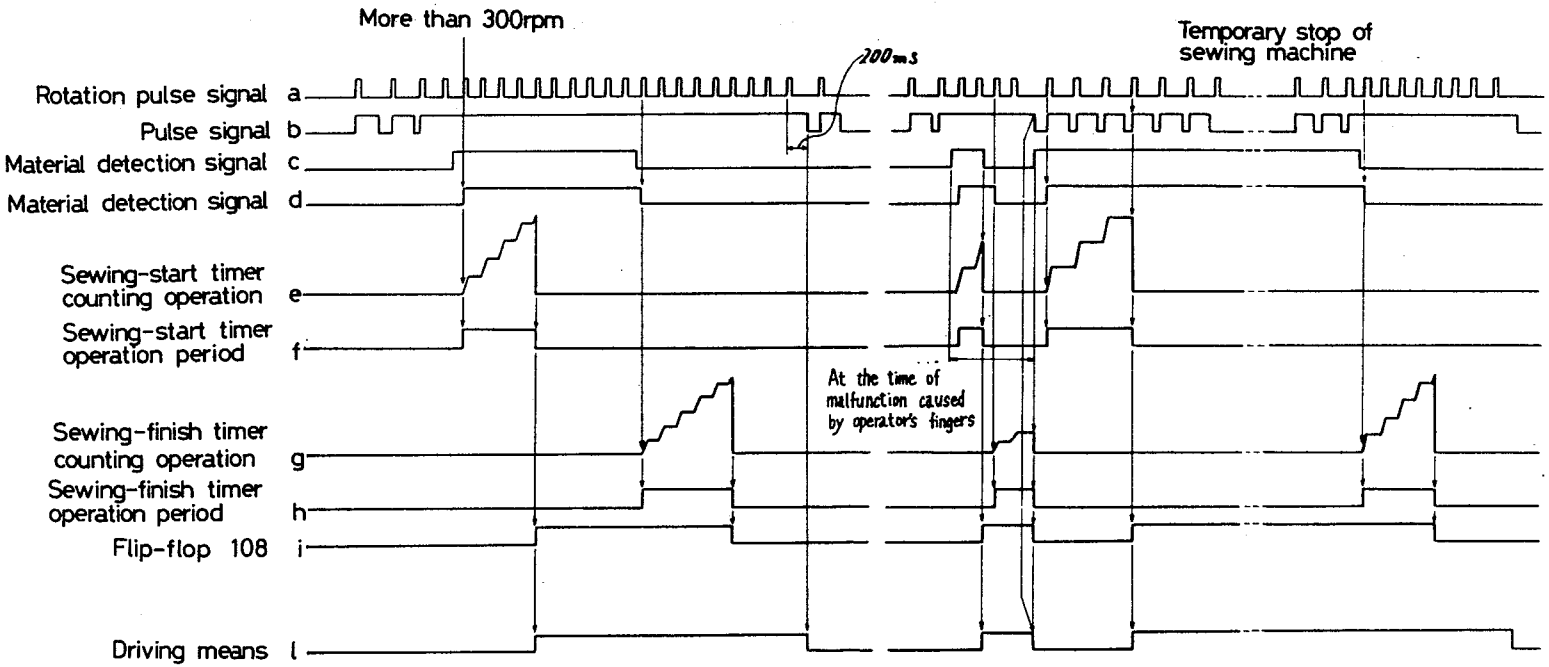
FIG. 7 is an operation timing chart of the embodiment of the present invention.

FIG. 6 is a block diagram showing a control circuit 100. Pulses generated by the pulse generator 77 are applied to a waveform shaping circuit 102 through a level converter 101. After the duration time and level of the pulses are shaped to certain values, the pulses are applied to a motion detector 103 of a stitching operation detection means and sewing-start and finish timers 104 and 105 of an operation delaying means, respectively.

The level converter 101 serves to convert the output level of pulse generator 77 to the input level of control circuit 100.

The output voltage of phototransistor 88 of the fabric material sensor 76 is applied to a comparison circuit 106. Said comparison circuit 106 gives a fabric material detection signal "c" to a flip-flop 107 when the output voltage of phototransistor 88 becomes lower than a predetermined reference voltage $E_s$, that is, when the sensor 76 detects the fabric material; the comparison circuit 106 stops giving the fabric material detection signal "c" to the flip-flop 107 when the output voltage of phototransistor 88 becomes higher than the $E_s$, that is, when the sensor 76 does not detect the fabric material. The reference voltage $E_s$ can be adjusted according to the kind of fabric material used.

The flip-flop 107 gives a start signal to a trigger gate $TG_1$ of sewing-start timer 104 when it receives the fabric material detection signal "c" from the comparison circuit 106, and gives a start signal to a trigger gate $TG_2$ of sewing-finish timer 105 when the output of comparison circuit 106 becomes zero.

When it receives the start signal from the flip-flop 107, the sewing-start timer 104 starts to count a pulse signal "a" sent from the wave form shaping circuit 102, and gives a set signal to a flip-flop 108 when the counted number becomes equal to a predetermined one. The flip-flop 108 gives a set signal to a flip-flop 109 when it receives the set signal from the sewing-start timer 104, and said flip-flop 109 gives an exciting signal to the rotary solenoid 17 of driving means 16, which drives the inner chaining-off finger 12, when it receives the set signal from the flip-flop 108.

The sewing-finish timer 105 starts to count the pulse signal "a" sent from the waveform shaping circuit 102 when it receives a start signal from the flip-flop 107, and gives a reset signal to the flip-flop 108 when the counted number becomes equal to a predetermined one, thus keeping the flip-flop 108 reset.

Both sewing-start and sewing-finish timers 104 and 105 are reset to their original states upon receiving the output of comparison circuit 106. Namely, the output of comparison circuit 106 is supplied directly to the sewing-finish timer 105, and to the sewing start timer 104 through a "NOT" circuit in such a way that when the output signal of comparison circuit 106 is given, that is, when the fabric material sensor 76 detects the fabric material, the sewing-finish timer 105 is rest; and, when no output signal is given from the coparison circuit 106, that is, when the sensor 76 does not detect the fabric material, the sewing-start timer 104 is reset.

The motion detector 103, which forms the stitching operation detection means together with the pulse generator 77, compares the frequency or period of pulse signal "a" sent from the shaping circuit 102 with a predetermined value and gives a timing signal to de-energize the driving means 16 when the frequency or period of pulse signal "a" becomes lower or longer than the predetermined value. The motion detector 103 gives a pulse signal "b" which has a certain pulse duration synchronized with the pulse signal "a". When the stitching operation of the sewing machine becomes faster and the pulse interval between pulse signals "a" becomes shorter than the pulse duration of pulse signal "b", the motion detector 103 gives the pulse signal "b" continuously. When the stitching operation of the sewing machines becomes slower and the pulse interval between pulse signals "a" becomes longer than the pulse duration of pulse signal "b", the pulse signal "b" becomes intermittent. In the preferred embodiment of the present invention, pulse signal "b" is generated continuously when the rotating member of pulley 89 of pulse generator 77 exceeds about 300 rpm, and then intermittently when the pulse interval between pulse signals "a" becomes longer than about 200 ms.

Pulse signal "b" is supplied to the flip-flop 109 through one input of a "NOR" circuit 111. When pulse signal "b" falls, that is, when the continuous supply of pulse signals is changed to the intermittent supply thereof, a reset signal is given to the flip-flop 109 to release the rotary solenoid 17 of driving means 16 from its excited state. The set signal is supplied from the flip-flop 108 through the other input of "NOR" circuit 111 to prevent the inner chaining-off finger from being retracted when the flip-flop 108 is set, that is, when the fabric material is present at needle drop points $N_1$ and $N_2$. Sewing-start and-finish timers 104 and 105 are provided with time controls (not shown) for adjustably determining sewing-start and-finish times, respectively.

To the output of level converter 101 is connected a rotation display LED (not shown) for displaying the pulse signal "a", and to the output of comparison circuit 106 a fabric material detection display LED (not shown) is connected for displaying the fabric material detection signal "c".

The output level of phototransistor 88 of fabric material sensor 76 is displayed by a level indicator 115.

Figure 8:
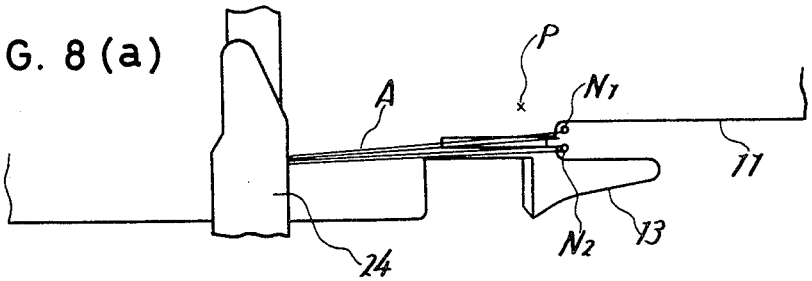
FIGS. 8*a*–8*e* are schematic views showing how thread chains are folded and sewn into the seam in the embodiment of the present invention.
Figure 8:
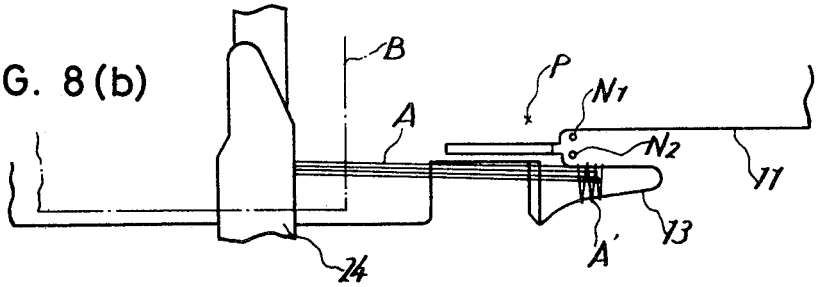
Figure 8:
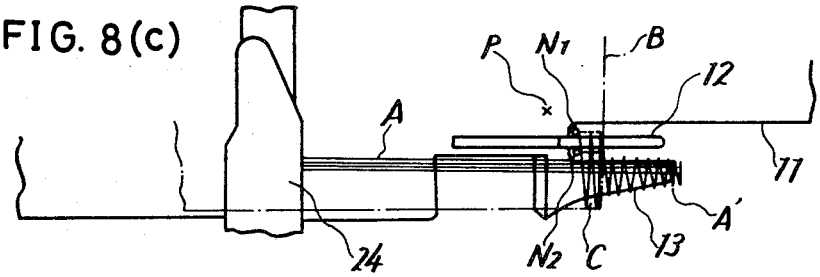
Figure 8:
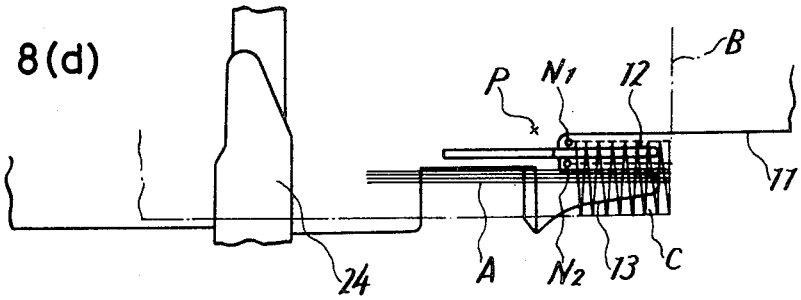
Figure 8:
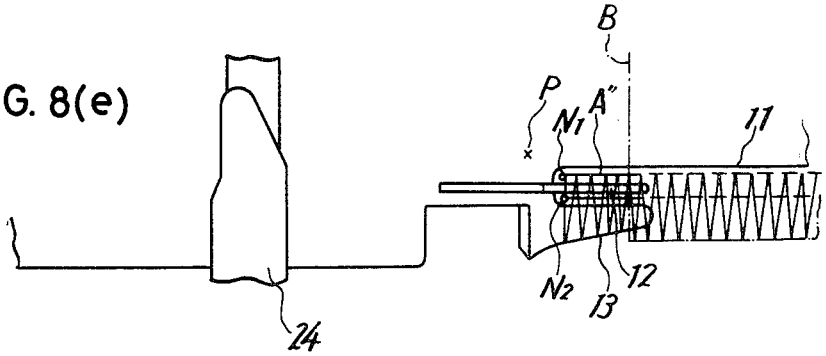

According to the embodiment of the present invention having such an arrangement as described above, continuous thread chains connected to the fabric material after the sewing process is finished are cut off from the fabric material and held by the thread chain holding and cutting means 24 in such a way that the cut ends of the thread chains A left on the side of the sewing machine are held by the means 24, as shown in FIG. 8*a*, after the fabric material is removed.

In this state the inner chaining-off finger 12 is kept in its retracted position. When a subsequent section of fabric material B is positioned and the sewing machine is operated, thread chains A′, continuous from thread chains A held by the thread chain holding and cutting means 24, are formed wrapped only around the outer chaining-off finger 13 as shown in FIG. 8*b*.

When the foremost end of fabric material B reaches the irradiation point P of photo-sensor 81, the sewing-start timer 104 of control circuit 100 starts to count the pulse signal "a". Therefore, having been set to a certain value by the time control, the sewing-start timer 104 gives a delayed set signal to the flip-flop 108 at the time when the foremost end of fabric material B reaches needle drop points $N_1$ and $N_2$ and the sewing process is started on the fabric material B. The flip-flop 108 further gives a set signal to the flip-flop 109 to hold the flip-flop 109 in set state and to excite the rotary solenoid 17 of driving means 16. The shaft 18 of rotary solenoid 17 is thus rotated to rotate the driving lever 19 in clockwise direction in FIG. 2, causing the inner chaining-off finger 12 to be advanced through the slide lever 15 and brought alongside the outer chaining-off finger 13, as shown in FIG. 8*c*. As the result, over-edging of the edge of the fabric material is correctly performed using both inner and outer chaining-off fingers 12 and 13, and thread chains A are folded and sewn into the seam C.

Thread chains A′, formed before the sewing process is applied to the fabric material B, are wrapped only around the outer chaining-off finger 13, so that they are narrow in width, similar to those formed with the one-needle overlock sewing machine. Narrow chains thus formed are positioned outside the outer needle drop point $N_2$, thus preventing thread chains held by the thread chain holding and cutting means from being sewn together with newly formed ones or sewn to the fabric material by the thread of the outer needle. The thread chains may therefore be smoothly folded and sewn into the seam C as shown in FIG. 8*d*.

When the trailing end of fabric material B passes through the point P, the sewing-finish timer 105 of control circuit 100 starts to count the pulse signal "a" and gives a reset signal to the flip-flop 108 at the time when the trailing end of fabric material B reaches needle drop points $N_1$ and $N_2$.

In the flip-flop 109 receives a reset signal from the motion detector 103 or the sewing machine is stopped in this state, the rotary solenoid 17 of driving means 16 will be de-energized to retract the inner chaining-off finger 12. However, if the sewing machine is still operated following the end of the fabric segment, thread chains A″ are formed while the flip-flop 109 is in set state and the inner chaining-off finger 12 remains in its advanced position as shown in FIG. 8*e*. As the result, thread chains "A" are formed symmetrically and beautifully, bridging the inner and outer chaining-off fingers 12 and 13, and can be beautifully folded and sewn into the seam of a subsequent section of fabric material.

When the stitching operation of the sewing machine becomes slow and the pulse interval of pulse signal "a" becomes longer than about 200 ms, the motion detector 103 gives a reset signal to the flip-flop 109, so that the flip-flop 109 is reset and the rotary solenoid 17 of driving means 16 is de-energized, thus causing the inner chaining-off finger 12 to be retracted to its original state through the slit 14 by the action of the return spring.

Continuous thread chains A", connected to the fabric material B, are then held and cut by the thread chain holding and cutting means 24, thus allowing thread chains A" to be again automatically folded and sewn into the seam at the time the sewing process is applied to a subsequent segment of fabric material.

Even if the sewing machine is temporarily stopped during the sewing process, flip-flops 108 and 109 are held in state until the trailing end of fabric material is detected by the fabric material sennsor 76. The rotary solenoid 17 of driving means 16 remains under excitation. Therefore, the sewing process can be instantly started again keeping this state.

According to the present invention as described above, the inner chaining-off finger is held in its retracted position before the start of the sewing process on the fabric material, and advanced at the same time the sewing process reaches the fabric. Therefore, thread chains formed before the start of sewing process are not wrapped or entangled around the inner chaining-off finger but are formed narrow in width, thus preventing thread chains held by the thread chain holding and cutting means from being sewn together with newly formed chains or sewn to the fabric material by the needle threads, and allowing thread chains to be folded and sewn into the seam smoothly.

In addition, thread chains are formed while keeping the inner chaining-off finger advanced after the finish of the sewing process on a fabric segment. Thread chains are thereby formed symmetrically and beautifully bridging the inner and outer chaining-off fingers and can be beautifully folded and sewn into the seam of a subsequent piece of fabric material.

What is claimed is:

1. A method for backtacking thread chains formed on a two-needle overlock sewing machine having an outer chaining-off finger on a needle plate of said machine and an inner chaining-off finger arranged alongside said outer chaining-off finger, needle drop points for the two needles being positioned on both sides of the inner chaining-off finger, the method comprising:

retractably arranging said inner chaining-off finger from an advanced position alongside the outer chaining-off finger;

shifting said inner chaining-off finger to the advanced position during a prescribed period of sewing machine operation; and;

shifting said inner chaining-off finger to a retracted position during the rest of the period of operation.

2. The method of claim 1, wherein the inner chaining-off finger is shifted to the advanced position at least during a period in which stitches are applied to a material.

3. The method of claim 2, wherein the inner chaining-off finger is also shifted to the advanced position during a period in which thread chains are formed after the sewing process passes a trailing end of the material.

4. The method of claim 3, wherein the inner chaining-off finger is retracted when the formation of thread chains past said trailing end falls below a predetermined rate.

5. The method of claim 1, further comprising repeating said shifting steps so that said inner chaining-off finger is caused to repeat the movements of advancing and the retracting during the prescribed period of each sewing machine operation for a plurality of segments of material.

6. A two-needle overlock sewing machine comprising:

an outer chaining-off finger rigidly attached to the machine;

an inner chaining-off finger having an advanced position alongside the outer chaining-off finger, the inner chaining-off finger being retractable from the advanced position in a direction opposite a feeding direction of material being sewn; and, control means adapted to advance the inner chaining-off finger, whereby the machine stitches over both the outer and advanced inner chaining-off fingers to stitch a relatively wider thread chain, the control means also being adapted to retract the inner chaining-off finger prior to sewing a fabric segment, whereby the machine stitches over only the outer chaining-off finger to form a relatively narrower thread chain which may be folded back free of the retracted inner chaining-off finger and sewn within subsequent stitches.

7. The machine of claim 6, wherein the inner chaining-off finger remains in the advanced position for a predetermined interval after a segment of material is sewn, whereby a relatively wider thread chain is left attached to a trailing end of the material.

8. A device for backtracking thread chains formed on a two-needle overlock sewing machine, comprising:

an outer chaining-off finger rigidly attached to the machine;

an inner chaining-off finger having an advanced position alongside the outer chaining-off finger, the inner chaining-off finger being retractable in a direction opposite a material feeding direction;

a driving means for reciprocating the inner chaining-off finger between the advanced and retracted positions;

a material detection means for detecting whether the material has been fed;

a stitching operation detection meas for detecting stitching operation of the sewing machine; and, a control circuit connected to said detection and driving means and adapted to advance the inner chaining-off finger when the material is detected by the material detection means, and to retract the inner chaining-off finger when the stitching operation of the sewing machine is not detected by the stitching operation detection means.

9. The device of claim 8, wherein the stitching operation detection means comprises a pulse generator for generating pulse synchronized with the stitching operation of the sewing machine, and a motion detector arranged in the control circuit and adapted to compare the frequency of pulses from the pulse generator with a predetermined value, the motion detector generating a timing signal to de-energize the driving means when the frequency of pulses becomes lowwer than the predetermined value.

10. The device of claim 9, wherein the pulse generator includes a pulley rotating synchronously with the stitching operation of the sewing machine, at least one permanent magnet embedded in the pulley, and a magnetic sensor arranged adjacent to the pulley.

11. The device of claim 8, wherein the material detection means senses material upstream of a needle drop point, and includes a delay means for generating a delayed timing signal, the delay corresponding to a time required for material at the material detection means to reach the needle drop point.

12. The device of claim 11, wherein the delay means is a timer which is enabled by an output signal of the material sensor and generates a timing signal when pulses generated by the pulse generator are counted to a predetermined number.

* * * * *

UNITED STATES PATENT AND TRADEMARK OFFICE

CERTIFICATE OF CORRECTION

PATENT NO. : 4,338,873

DATED : July 13, 1982

INVENTOR(S) : Yoshinari Ueyama; Kikuo Mori; Hideo Matsushita

It is certified that error appears in the above-identified patent and that said Letters Patent are hereby corrected as shown below:

Fig. 6 upper right corner, is corrected as shown:

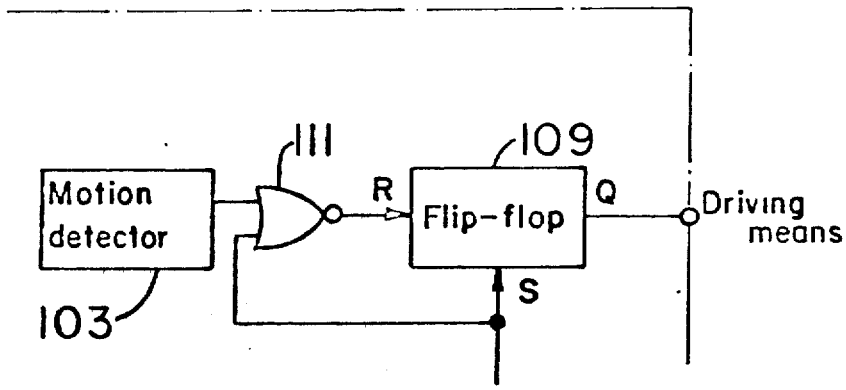

Column 3, line 16, "slot" should be --slit--.
Column 5, line 11, "rest" should be --reset--.
Column 5, line 12, "coparison" should be --comparison--.
Column 6, line 48, "In" should be --If--.
Column 6, line 57, delete the quote marks before 'A' to read --A''--.
Claim 8, line 1, "backtracking" should be --backtacking--.
Claim 8, line 14, "meas" should be --means--.

UNITED STATES PATENT AND TRADEMARK OFFICE

CERTIFICATE OF CORRECTION

PATENT NO. 4,338,873

DATED July 13, 1982

INVENTOR(S) Yoshinari Ueyama et al

It is certified that error appears in the above-identified patent and that said Letters Patent is hereby corrected as shown below:

Claim 9, line 9, "lowwer" should be -- lower --.

Signed and Sealed this

*Twenty-seventh* Day of *March 1984*

[SEAL]

*Attest:*

GERALD J. MOSSINGHOFF

*Attesting Officer*

*Commissioner of Patents and Trademarks*